US005932131A

United States Patent [19]

Joo et al.

[11] Patent Number: 5,932,131

[45] Date of Patent: Aug. 3, 1999

[54] MICROWAVE OVEN WITH DIFFERENT PHASE MICROWAVE STREAMS

[75] Inventors: Ki-Hun Joo; Tae-Bong Kim; Eung-Sup Lee; Jong-Sup Shin, all of Suwon, Rep. of Korea

[73] Assignee: Samsung Electronics Co., Ltd., Suwon, Rep. of Korea

[21] Appl. No.: 08/923,288

[22] Filed: Sep. 4, 1997

[30] Foreign Application Priority Data

Apr. 3, 1997 [KR] Rep. of Korea ..... 97-12408

[51] Int. Cl.[6] ..... H05B 6/70

[52] U.S. Cl. ..... 219/746; 219/748; 219/750; 219/747

[58] Field of Search ..... 219/747, 746, 219/748, 750, 695, 696, 697

[56] References Cited

U.S. PATENT DOCUMENTS

| | | | |
|---|---|---|---|
| 3,210,511 | 10/1965 | Smith | 219/746 |
| 4,336,434 | 6/1982 | Miller | 219/750 |
| 4,446,349 | 5/1984 | Smith | 219/746 |
| 4,464,554 | 8/1984 | Bakanowski et al. | 219/746 |
| 4,621,179 | 11/1986 | Kusunoki et al. | 219/747 |
| 5,237,139 | 8/1993 | Berg et al. | 219/746 |
| 5,632,921 | 5/1997 | Risman et al. | 219/750 |

FOREIGN PATENT DOCUMENTS 6-111933 4/1994 Japan .

*Primary Examiner*—Philip H. Leung
*Attorney, Agent, or Firm*—Larson & Taylor

[57] ABSTRACT

A microwave oven is disclosed in which the structure of the wave guiding tube is improved such that the variation of the impedance is minimized in spite of the variation of the load of the food, thereby making it possible to maintain the output of the microwave oven at a constant level regardless of the load of the food. The microwaves are divided into a plurality of wave streams, and the wave streams are made to have different phases. The microwave oven includes an input wave guiding tube coupled with a magnetron, for receiving microwaves from the magnetron. A first output wave guiding tube communicates to the input wave guiding tube, for receiving the microwaves from the input wave guiding tube to diffusely irradiate the microwaves into a cavity. A second wave guiding tube communicates to the input wave guiding tube, for converting the microwaves to a phase different from that of the first wave guiding tube to irradiate them into the cavity.

3 Claims, 5 Drawing Sheets

MICROWAVE OVEN WITH DIFFERENT PHASE MICROWAVE STREAMS

BACKGROUND OF THE INVENTION

1. Field of the Invention

The present invention relates to a microwave oven for cooking a food by supplying microwaves to the food. More specifically, the present invention relates to a microwave oven in which the impedance variation of a wave guiding tube versus the load variation of the food to be cooked is minimized, so that the output of the microwave oven would become constant regardless of the load of the food, and that the electric field distribution within the cavity would also become constant.

2. Description of the Prior Art

Generally, in a microwave oven, microwaves which have been generated in a magnetron are irradiated through a wave guiding tube into a cavity to induction-heat the food within the cavity so as to cook the food.

FIG. 1 is a schematic sectional view showing a wave guiding tube of a conventional microwave oven. FIG. 2 is an interpretation of the irradiating structure of the wave guiding tube of FIG. 1. The wave guiding tube 1 is provided with an insertion hole 9 on a side thereof for inserting a magnetron 3. On the other side of the wave guiding tube 1, there is formed a rectangular opening 7 for irradiating the microwaves from the magnetron 3 into the interior of the cavity.

The microwaves which have been generated by the magnetron 3 are irradiated through the wave guiding tube 1 into the interior of the cavity 5 as described above, so that the food within the cavity 5 would be induction-heated.

As shown in FIG. 2, it will be assumed that the power of the magnetron is $P_{in}$, and the output supplied to a particular position is $P_{out}$. Then $P_{out}$ can be calculated based on the following formulas.

$$P_{in}=E_s^2 \quad \text{[Formula 1]}$$

$$E_y=E_s \sin(x) \quad \text{[Formula 2]}$$

$$P_{out}=(E_y)^2=(E_s \sin(x))^2=E_s^2 \sin(x)^2 \quad \text{[Formula 3]}$$

In the Formulas 1 to 3, $E_s$ is an input electric field energy of the microwaves which are generated and guided by the wave guiding tube. $E_y$ is an output electric field energy of the microwaves, which is supplied to a particular position within the cavity 5.

The output of the magnetron 3 amounts to a square of the electric field energy $E_s$.

Further, the microwaves which are generated by the magnetron 3 are sinusoidal waves. Therefore, the electric field energy $E_y$ which is supplied to a particular position within the cavity 5 takes the form of the electric field energy $E_s$ multiplied by sin(x). The output power $P_{out}$ supplied to a particular position within the cavity amounts to a square of $E_y$.

Therefore, the output $P_{out}$ supplied to a particular position within the cavity 5 takes the form of $P_{in}$ multiplied by sin(x). The term sin(x) is varied in accordance with the load of the food to be cooked, and therefore, $P_{out}$ is also varied in accordance with the load of the food to be cooked.

Thus the impedance characteristics which are governed by the load of the food can be illustrated by the polar chart of FIG. 3. In this drawing, the impedance characteristics of the wave guiding tube are illustrated for the case where the frequency range of the microwaves is 2.44–2.47 GHz, and where the loads consist of 2000 cc of water, 1000 cc of water, 500 cc of water and 100 cc of water.

As shown in FIG. 3, in the case where the load is 2000 cc of water, VSWR (voltage standing wave ratio), i.e., the impedance of the wave guiding tube becomes small so as to increase the output of the microwave oven. On the other hand, in the case where the load is 100 cc of water, VSWR, i.e., the impedance of the wave guiding tube becomes large so as to decrease the output of the microwave oven.

That is, if the load of the food is large, the output of the microwave oven increases somewhat, while if the load is small, the impedance of the wave guiding tube increases so as to lower the output of the microwave oven.

Further, the impedance of the wave guiding tube is greatly varied in accordance with the variation of the load of the food, with the result that the electric field distribution within the cavity becomes non-constant.

Further, if the output of the microwave oven is to be improved, then a matching has to be realized between the impedance of the wave guiding tube and the impedance of the cavity. However, in the above described microwave oven, the wave guiding tube is designed such that it should have an impedance matching with a particular cavity. Therefore, one wave guiding tube cannot be applied to various cavities, but a separate wave guiding tube has to be designed for each cavity, this being a troublesome task.

Meanwhile, Japanese Patent Application Laid-open No. Hei-6-111933 discloses a wave guiding system for a microwave oven. In this system, the uniform heating for food within the cavity of microwave oven is improved, and the wave guiding tube has a short length. so that the positioning of components can be made easier. This is illustrated in FIG. 4. As shown in this drawing, the microwave oven includes: a pair of wave supplying holes 11*a* and 11*b* formed on a side wall; a cavity 12 for receiving a food to be cooked; and a magnetron 14 isolated from the side wall (having the wave supplying holes 11*a* and 11*b*), and disposed at a level between the wave supplying holes 11*a* and 11*b*, for generating microwaves of a frequency of $\lambda_g$ through an antenna 13. The microwave oven further includes a wave guiding tube 15 separated from the antenna 13 by a distance of $\lambda g/4$, covering the wave supplying holes 11*a* and 11*b*, supporting the magnetron 14 and guiding the microwaves through the wave supplying holes 11*a* and 11*b* into a cavity 12. Voltages standing waves are formed from the waves of the magnetron 14 within the wave guiding tube 15, to irradiate them through the wave supplying holes 11*a* and 11*b* into the cavity 12 so as to cook the food.

In this conventional wave guiding system, a pair of the wave supplying holes 11*a* and 11*b* are formed on a side wall of the cavity 12 at different levels. Further, the microwaves which are generated by the magnetron 14 are irradiated through the wave supplying holes 11*a* and 11*b* into the cavity 12. Therefore, only the dispersing characteristic of the microwaves is improved to uniformly heat the food. However, the variation of the output of the microwave oven cannot properly respond to the variation of the load of the food.

SUMMARY OF THE INVENTION

The present invention is intended to overcome the above described disadvantages of the conventional techniques.

Therefore, it is an object of the present invention to provide a microwave oven in which the structure of the wave guiding tube is improved such that the variation of the impedance is minimized in spite of the variation of the load of the food, thereby making it possible to maintain the output of the microwave oven at a constant level regardless of the load of the food.

It is another object of the present invention to provide a microwave oven in which the variation of the impedance is minimized in spite of the variation of the load of the food, thereby maintaining the electric field distribution in a constant state.

In achieving the above object, the microwave oven includes a wave guiding tube including: an input wave guiding tube coupled with a magnetron, for receiving microwaves from the magnetron; a first output wave guiding tube communicating to the input wave guiding tube, for receiving the microwaves from the input wave guiding tube to diffusely irradiate the microwaves into a cavity; and a second output wave guiding tube communicating to the input wave guiding tube, for converting the microwaves to a phase different from that of the first output wave guiding tube to spreadly irradiate them into the cavity. Thus the microwaves are divided into a plurality of streams, and the streams are made to have different phases before being irradiated into the cavity. Consequently, the variation of the impedance is minimized in spite of the variation of the load, and therefore, the output of microwave oven can be maintained at a constant level, as well as maintaining the electric field distribution in a constant state.

BRIEF DESCRIPTION OF THE DRAWINGS

The above objects and other advantages of the present invention will become more apparent by describing in detail the preferred embodiment of the present invention with reference to the attached drawings in which.

DETAILED DESCRIPTION OF THE PREFERRED EMBODIMENT

Figure 5:
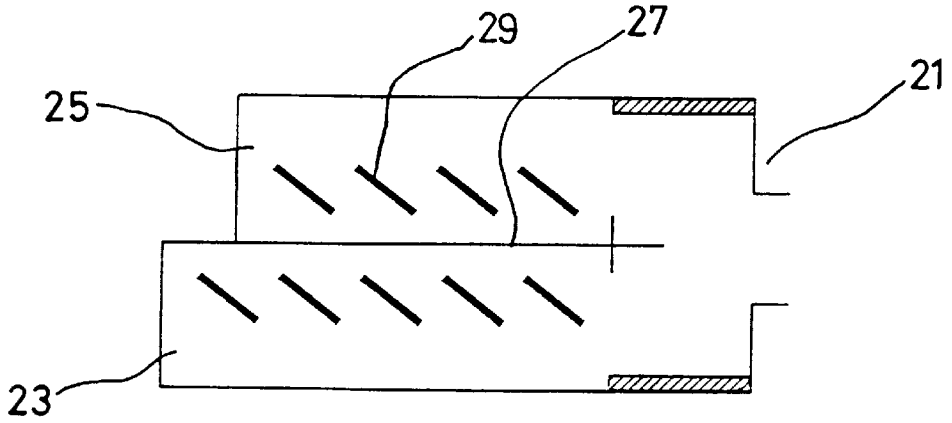
FIG. 5 is a schematic view showing a first embodiment of the wave guiding tube of the microwave oven according to the present invention.

FIG. 5 is a schematic view showing a first embodiment of the wave guiding tube of the microwave oven according to the present invention. The wave guiding tube of FIG. 5 is a top feeding type tube in which microwaves are irradiated from the top into the cavity.

As shown in FIG. 5, the wave guiding tube of the first embodiment includes an input wave guiding tube 21, a first output wave guiding tube 23 and a second output wave guiding tube 25. The first and second output wave guiding tubes 23 and 25 are separated from each other by an intermediate stub 27. The first and second output wave guiding tubes 23 and 25 respectively include a plurality of openings 29 through which the microwaves are irradiated into the cavity.

The input wave guiding tube 21 is coupled to a magnetron (not shown in the drawings), for supplying the microwaves from the magnetron to the first and second output wave guiding tubes 23 and 25. The first output wave guiding tube 23 communicates to the input wave guiding tube 21, for supplying the microwaves from the input wave guiding tube 21 through the openings 29 into the cavity.

The second output wave guiding tube 25 communicates to the input wave guiding tube 21, for converting the microwaves to a phase different from that of the first output wave guiding tube 23, before irradiating them into the cavity.

The first and second output wave guiding tubes 23 and 25 are designed such that they should irradiate sine waves and cosine waves respectively. The microwaves which are irradiated by the first output wave guiding tube 23 are sine waves, while the microwaves which are irradiated by the second output wave guiding tube 25 are cosine waves.

Figure 6:
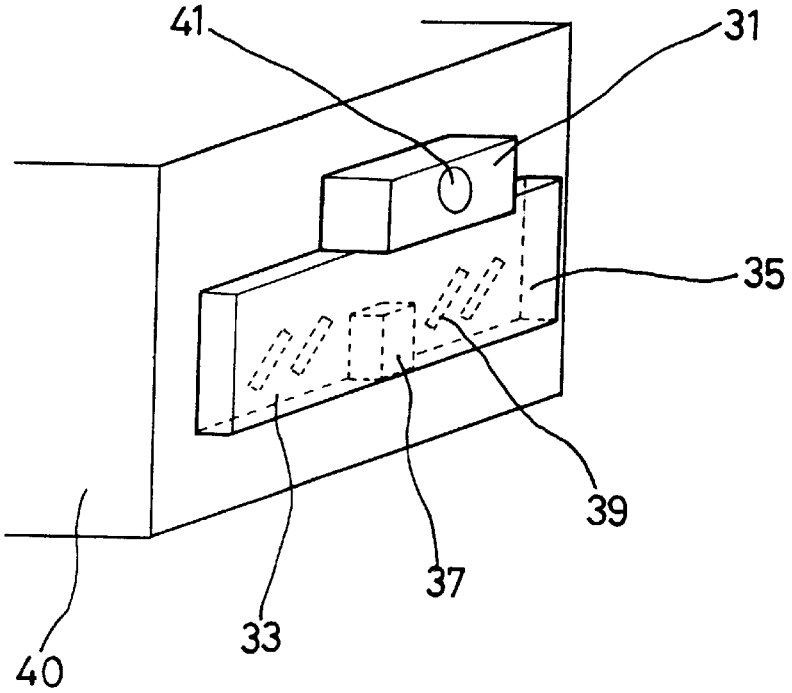
FIG. 6 is a schematic perspective view showing a second embodiment of the wave guiding tube according to the present invention.

FIG. 6 is a schematic perspective view showing a second embodiment of the wave guiding tube according to the present invention. In the wave guiding tube of FIG. 6, the microwaves are irradiated into the cavity through a side wall of it.

As shown in FIG. 6, the wave guiding tube of the second embodiment of the present invention includes an integrally formed input wave guiding tube 31, a first output wave guiding tube 33 and a second output wave guiding tube 35. The first output wave guiding tube 33 and the second output wave guiding tube 35 are formed beneath the input wave guiding tube 31.

The first output wave guiding tube 33 and the second output wave guiding tube 35 are separated from each other by an intermediate stub 37. The first output wave guiding tube 33 and the second output wave guiding tube 35 are respectively provided with two openings 39 through which the microwaves are irradiated into the cavity.

The input wave guiding tube 31 is provided with an insertion hole 41 for inserting a magnetron (not shown in the drawings). The input wave guiding tube 31 is coupled to the magnetron to supply the microwaves of the magnetron to the first output wave guiding tube 33 and to the second output wave guiding tube 35. The first output wave guiding tube 33 communicates to the input wave guiding tube 31, for supplying the microwaves from the input wave guiding tube 31 to the cavity 40.

The second output wave guiding tube 35 communicates to the input wave guiding tube 31, for converting the microwaves to a phase different from that of the first output wave guiding tube 33, before irradiating them into the cavity 40.

The first and second output wave guiding tubes 33 and 35 are designed such that they should irradiate sine waves and cosine waves respectively. The microwaves which are irradiated by the first output wave guiding tube 33 are sine waves, while the microwaves which are irradiated by the second output wave guiding tube 35 are cosine waves.

The lengths of the first and second output wave guiding tubes 33 and 35 are determined based on a position where the phase becomes zero. Therefore, the length of the first output wave guiding tube 33 is designed to be longer than that of the second output wave guiding tube 35 by as much as a half phase, so that the first and second output wave guiding tubes 33 and 35 would output different phases, i.e., sine waves and cosine waves respectively.

Further, the impedance of the wave guiding tube can be arbitrarily adjusted by adjusting the height and width of the intermediate stub 37 which is disposed between the first and second output wave guiding tubes 33 and 35.

Meanwhile, the openings 39 which are formed in the first and second output wave guiding tubes 33 and 35 are designed in such a manner as to satisfy the following formula.

$$X \cdot Y = G_1 \cdot G_2 \quad \text{[Formula 4]}$$

In the above formula, X and Y are the conductivities of the respective openings, and $G_1$ and $G_2$ are the conductivities of the respective output wave guiding tubes.

The first and second embodiments of the present invention constituted as above will now be described as to their action and effects.

In the first embodiment of the microwave oven according to the present invention, the microwaves are transferred through the input wave guiding tube 21 to the first and second output wave guiding tubes 23 and 25.

That is, the microwaves which have been generated by the magnetron are transferred partly to the first output wave guiding tube 23 and partly to the second output wave guiding tube 25.

The first and second output wave guiding tubes 23 and 25 receive the microwaves from the input wave guiding tube 21 to irradiate them through the openings 29 into the cavity.

The first and second output wave guiding tubes 23 and 25 output microwaves of different phases, i.e., sine waves and cosine waves into the cavity respectively.

Meanwhile, in the second embodiment of the present invention like in the first embodiment, the microwaves are transferred through the input wave guiding tube 31 to the first and second output wave guiding tubes 33 and 35 which are positioned beneath the input wave guiding tube 31.

The first and second output wave guiding tubes 33 and 35 receive the microwaves from the input wave guiding tube 31 to irradiate them through the openings 39 into the cavity. Further, the first and second output wave guiding tubes 33 and 35 respectively output microwaves of different phases.

Figure 7:
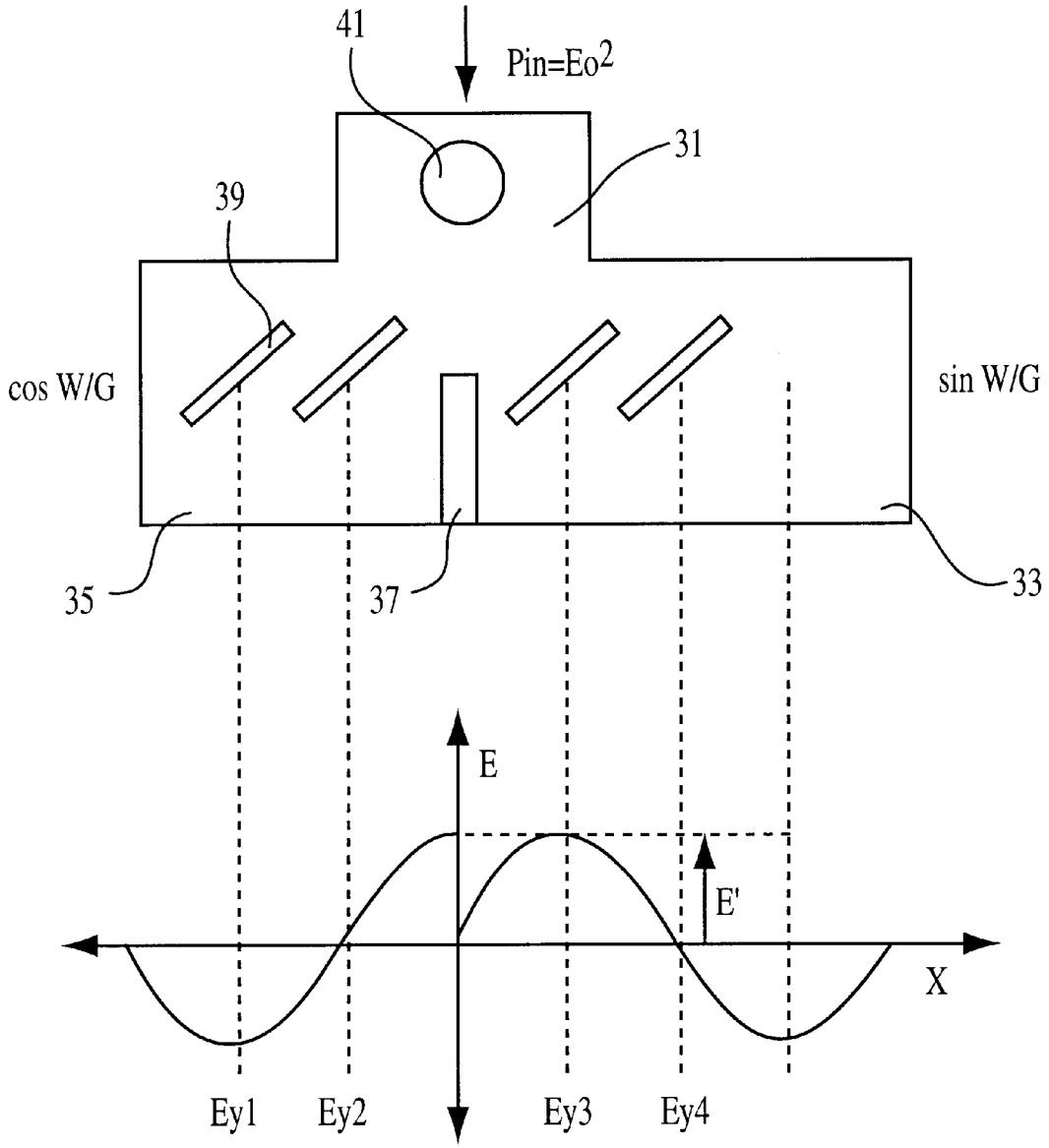
FIG. 7 is an interpretation of the irradiating pattern for the second embodiment of the wave guiding tube according to the present invention.

FIG. 7 is an interpretation of the irradiating pattern for the second embodiment of the wave guiding tube according to the present invention. This interpretation chart can be applied also to the first embodiment of the present invention.

In the second embodiment of the microwave oven according to the present invention, $P_{out}$ which is the power supplied to a particular position within the cavity corresponding to $P_{in}$ (the output of the magnetron) can be calculated based on Formulas 5 to 12.

$$P_{in} = E_o^2 \quad \text{[Formula 5]}$$

$$E_{y1} = E'_o \cos(x) \quad \text{[Formula 6]}$$

$$E_{y2} = E'_o \cos(x) \quad \text{[Formula 7]}$$

$$E_{y3} = E'_o \sin(x) \quad \text{[Formula 8]}$$

$$E_{y4} = E'_o \sin(x) \quad \text{[Formula 9]}$$

$$P_{out} = (E_{y1})^2 + (E_{y4})^2 + (E_{y2})^2 + (E_{y3})^2 \quad \text{[Formula 10]}$$

$$P_{out} = E'^2_o \sin(x)^2 + E'^2_o \cos(x)^2 + E'^2_o \sin(x)^2 + E'^2_0 \cos(x)^2 \quad \text{[Formula 11]}$$

$$P_{out} = E'^2_o \{2 \sin(x)^2 + \cos(x)^2\} = 2E'^2_o = P_{in} = \text{const.} * \sin(x)^2 + \cos(x)^2 = 1 \quad \text{[Formula 12]}$$

In the above formulas 5 to 12, $E_o$ is the electric field energy of the microwaves of the magnetron, i.e., the input electric field energy. $E_y$ is the electric field energy supplied to a particular position within the cavity, i.e., the output electric field energy.

The magnetron output $P_{in}$ amounts to a square of the electric field energy $E_o$ of the microwaves, and the microwaves are outputted from the first and second output wave guiding tubes 33 and 35 in the forms of sine waves and cosine waves respectively.

The electric field energies $E_{y1}$, $E_{y2}$, $E_{y3}$, and $E_{y4}$ which are supplied to the particular positions within the cavity 40 amount to $E'_o$. (which is the electric field energy transmitted to the respective output wave guiding tubes 33 and 35) multiplied by sin(x) and cos(x) respectively. The sum addition of the squares of the electric field energies $E_{y1}$, $E_{y2}$, $E_{y3}$, and $E_{y4}$ is $P_{out}$ which is the sum addition of the electric field energies at the particular positions within the cavity.

As is seen in Formula 12, $P_{out}$ which is the sum addition of the electric field energies at the particular positions within the cavity equals to $P_{in}$, and is constant.

That is, the output of a microwave oven is equivalent to the sum addition of the microwave energies which are outputted through the openings 39 of the respective output wave guiding tubes 33 and 35. The microwaves which are outputted through the openings 39 have symmetric magnitudes and phases, and therefore, the magnitude of the energy of the microwaves is equivalent to the sum addition of the microwaves outputted through the openings 39. Therefore, their phases are offset from each other, thereby outputting a constant output.

Figure 8:
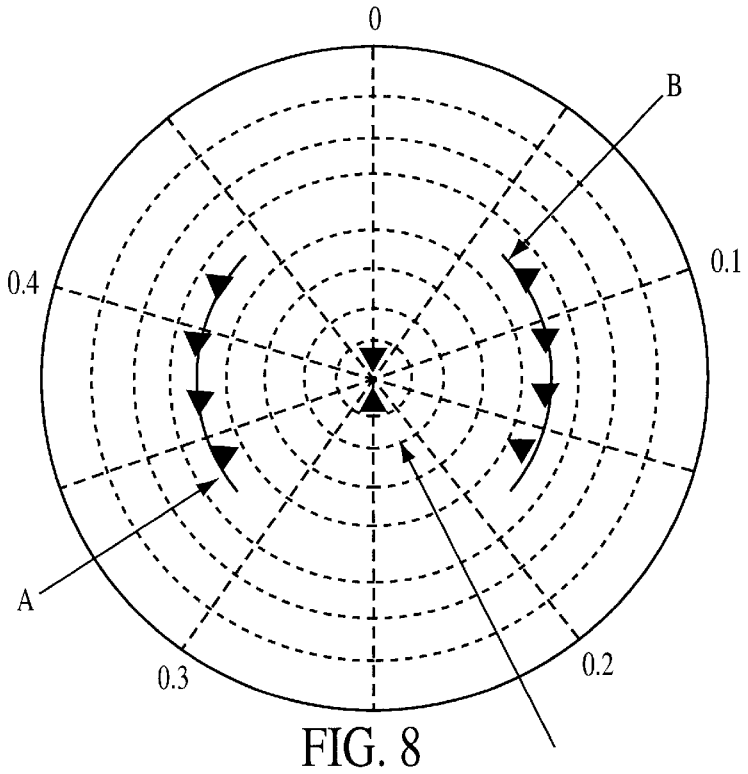
FIG. 8 is a polar chart showing the variation of the impedance in the second embodiment of the wave guiding tube according to the present invention.

FIG. 8 is a polar chart showing the variation of the impedance in the second embodiment of the wave guiding tube according to the present invention. FIG. 8 can be also applied to the first embodiment of the present invention.

As shown in FIG. 8, if the impedance is measured after closing the openings 39 of the first output wave guiding tube 33 and by varying the load, then the impedance of the wave guiding tube, i.e., the VSWR and the phase are varied as shown in the left portion A of FIG. 8.

Meanwhile, if the impedance is measured after closing the openings 39 of the second output wave guiding tube 35 and by varying the load, then the impedance of the wave guiding tube, i.e., the VSWR and the phase are varied as shown in the right portion B of FIG. 8.

That is, the impedance variation in the case where the openings 39 of the first output wave guiding tube 33 are closed and the load is varied is opposite to the impedance variation for the case where the openings 39 of the second output wave guiding tube 35 are closed and the load is varied. Therefore, the impedance variations are offset in the sum addition of the waves, with the result that the impedance variation becomes low in the relative terms.

Figure 9:
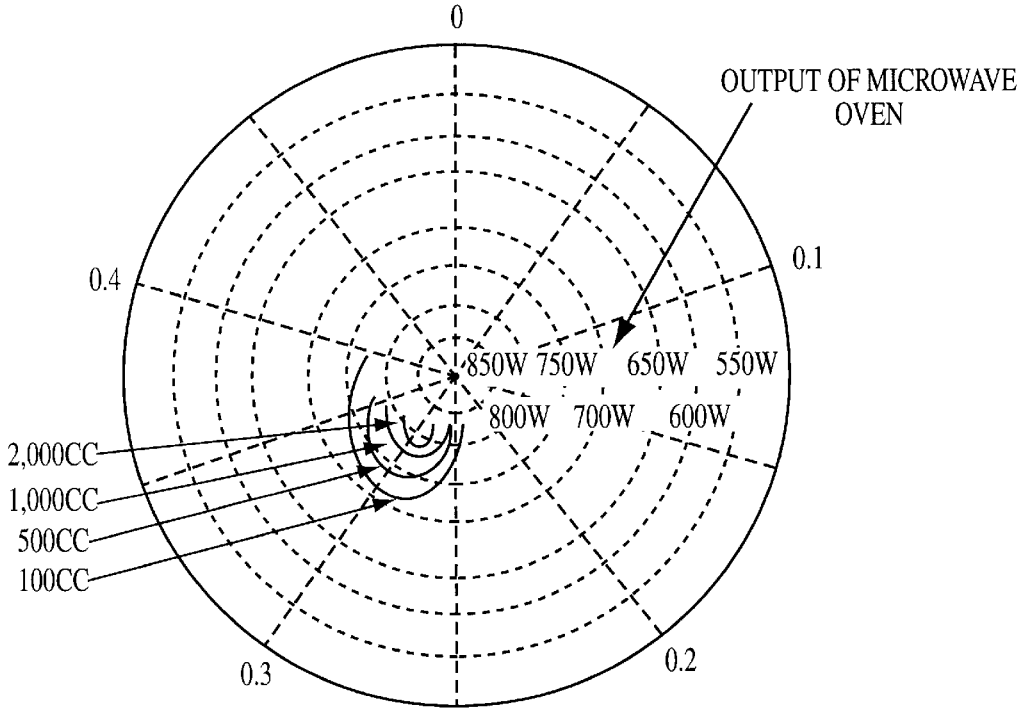
FIG. 9 is a polar chart showing the impedance characteristics versus the variation of the load in the second embodiment of the wave guiding tube according to the present invention.

The impedance characteristics versus the variation of the load of food as described above can be illustrated as in FIG. 9. In FIG. 9 like in FIG. 3, the test conditions were a frequency of 2.44–2.47 GHz, and loads of 2000 cc of water, 1000 cc of water, 500 cc of water, and 100 cc of water.

Figure 2:
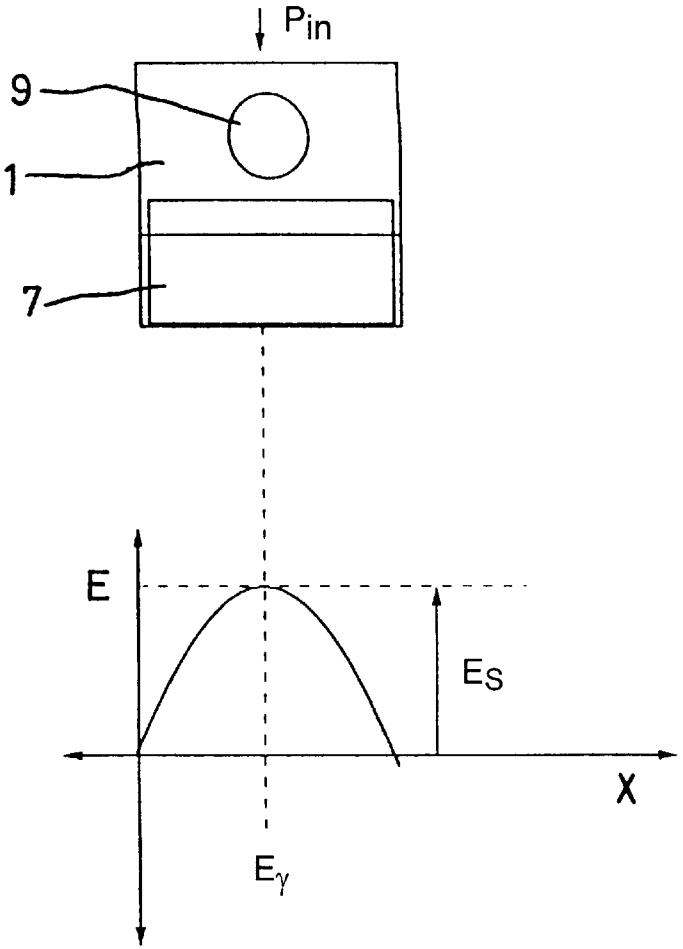
FIG. 2 (PRIOR ART)
FIG. 2 is an interpretation of the irradiating structure of the wave guiding tube of FIG. 1.
Figure 1:
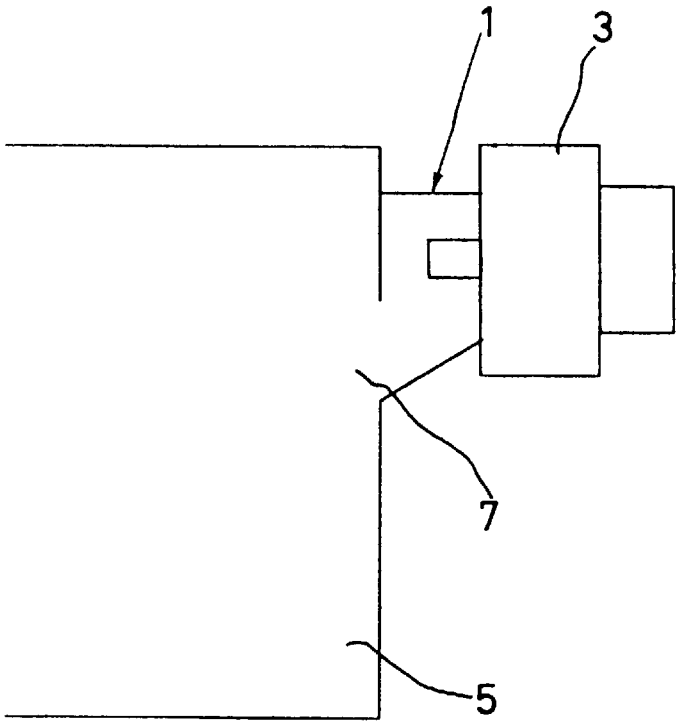
FIG. 1 (PRIOR ART)
FIG. 1 is a schematic sectional view showing a wave guiding tube of a conventional microwave oven.
Figure 3:
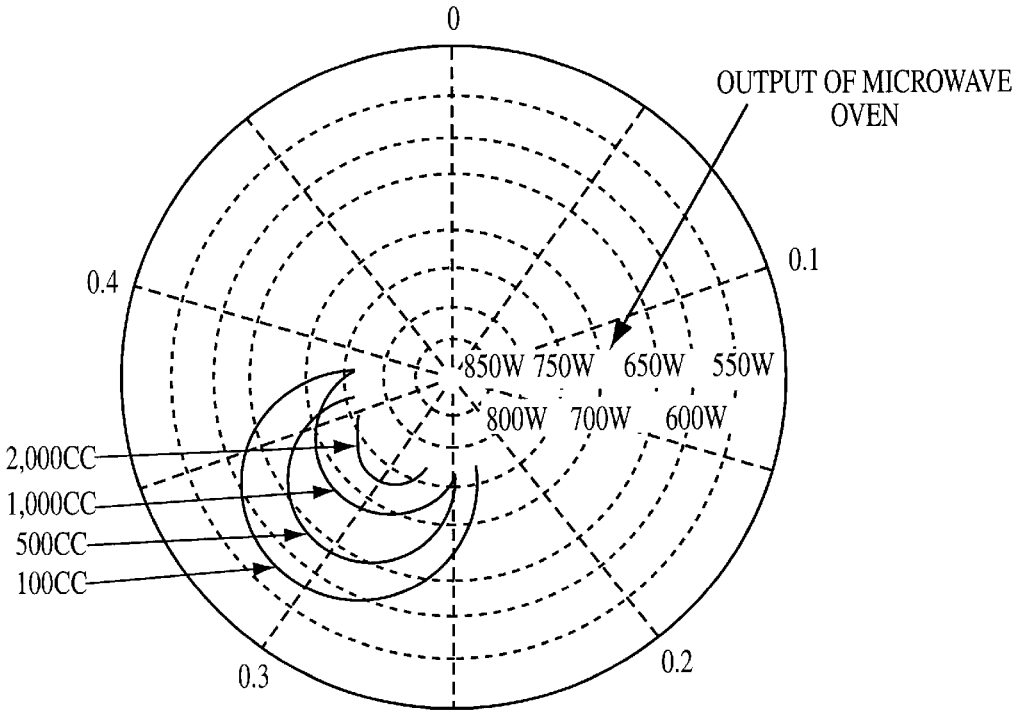
FIG. 3 PRIOR ART
FIG. 3 illustrates the impedance characteristics versus the load of the food in the wave guiding tube of FIG. 1.
Figure 4:
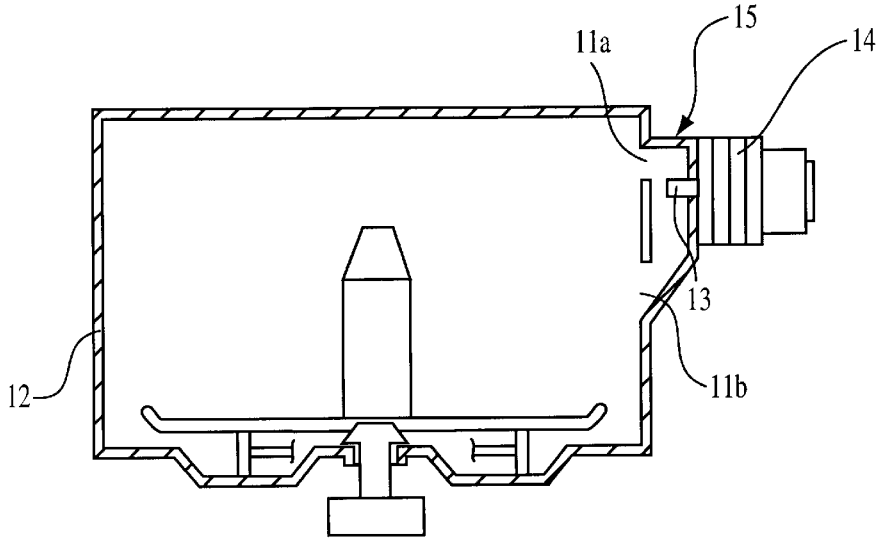
FIG. 4 PRIOR ART
FIG. 4 is a schematic sectional view showing another example of the conventional microwave oven.

If the impedance variation of FIG. 9 is compared with the impedance variation of FIG. 3, the following fact is found. That is, in the present invention, the VSWR, i.e., the impedance of the wave guiding tube is lower than that of the conventional one, and therefore, the output of the microwave oven become larger.

Particularly, in the case where the load is small, the VSWR, i.e., the impedance of the wave guiding tube becomes small, and therefore, the output of the microwave oven becomes larger.

Further, the variation of the impedance of the wave guiding tube versus the variation of the load of food becomes smaller, with the result that the electric field distribution becomes constant.

According to the present invention as described above, the microwaves generated by the magnetron are divided into a plurality of streams in irradiating them into the cavity, and the divided streams are made to have different phases. Thus the variation of the impedance of the wave guiding tube versus the variation of the load (food) is minimized, so that the output of the microwave oven would be constant regardless of the load, and that the electric field distribution within the cavity would also be constant.

What is claimed is:

1. A microwave oven for cooking a food by induction-heating of the food within a cavity by irradiating microwaves, said oven comprising:

a magnetron which generates microwaves;

a cavity within which the food is induction-heated by irradiation with the microwaves generated by said magnetron; an input wave guiding tube coupled with said magnetron, for receiving microwaves from said magnetron;

a first output wave guiding tube communicating with said input wave guiding tube, for receiving a first stream of the microwaves from said input wave guiding tube to diffusely irradiate the first stream of microwaves through first openings into said cavity; and a second output wave guiding tube communicating with said input wave guiding tube, for receiving a second stream of the microwaves from said input wave guiding tube and for converting the second stream of the microwaves to a phase different from that of the first stream from said first output wave guiding tube to diffusely irradiate the second stream of the microwaves through second openings arranged parallel with said first openings into said cavity together with the first stream; and an intermediate stub which is centrally disposed intermediate said first and second openings and which separates said first and second output wave guiding tubes from one another.

2. The microwave oven as claimed in claim 1, wherein said second output wave guiding tube forms a phase difference of 90 degrees on the second stream microwaves generated by said magnetron and relative to the first stream of microwaves passing through said first output wave guiding tube.

3. The microwave oven as claimed in claim 1, wherein a length of said first output wave guiding tube is longer than a length of said second output wave guiding tube by as much as a half phase of the microwaves.

* * * * *